United States Patent [19]

Nakamura et al.

[11] Patent Number: 4,855,641

[45] Date of Patent: Aug. 8, 1989

[54] TRANSPARENT ELECTRODES OF THIN-FILM ELECTROLUMINESCENCE PANEL

[75] Inventors: Noriaki Nakamura; Masashi Kawaguchi; Yasuo Sonoyama, all of Nara, Japan

[73] Assignee: Sharp Kabushiki Kaisha, Osaka, Japan

[21] Appl. No.: 166,893

[22] Filed: Mar. 11, 1988

[30] Foreign Application Priority Data

Mar. 13, 1987 [JP] Japan ..... 62-59658

[51] Int. Cl.[4] ..... H05B 33/26

[52] U.S. Cl. ..... 313/505; 313/503

[58] Field of Search ..... 313/500, 503, 506, 505; 428/573

[56] References Cited

U.S. PATENT DOCUMENTS 3,289,198 11/1966 Dickson, Jr. et al. ..... 313/506 X 3,717,800 2/1973 Thillays et al. ..... 313/500 X

*Primary Examiner*—Kenneth Wieder

*Attorney, Agent, or Firm*—Flehr, Hohbach, Test, Albritton & Herbert

[57] ABSTRACT

A thin-film EL panel of the layer structure with transparent electrodes and back electrodes sandwiching therebetween insulative layers and a light-emitting layer and forming display picture elements on the panel is characterized as having the transparent electrodes shaped differently at these display picture elements and other places.

5 Claims, 16 Drawing Sheets

TRANSPARENT ELECTRODES OF THIN-FILM ELECTROLUMINESCENCE PANEL

BACKGROUND OF THE INVENTION

This invention relates to the structure of transparent electrodes of a thin-film electroluminescence (EL) panel.

The structure of conventional thin-film EL panels is shown in FIGS. 22 and 23, FIG. 22 relating to a thin-film EL panel with a small display area, for example, of 512×128 dots and FIG. 23 relating to another with a somewhat larger display area, for example, of 640×400 dots. As shown in these figures, conventional thin-film EL panels have a plurality of transparent electrodes 11 comprising indium oxide ($In_2O_3$) (hereinafter referred to as ITO films) formed transversely on a glass substrate 10 at specified intervals and a first insulative layer 12, a light-emitting layer (not shown), a second insulative layer 13 and back electrodes 14 of Al or the like stacked on top of these ITO films in this order, and the ITO films 11 are generally so formed as to have uniform thicknesses and widths. Numerals 15 indicate Al-Ni terminals which are formed on the glass substrate 10 near its edges for connecting the end parts of the ITO films 11, numeral 16 indicates a display part and numerals 17 indicate display picture elements. With conventional thin-film EL panels of this type, breakdown points (hereinafter abbreviated into BP) 18 frequently occur in the display picture elements 17 during the operation.

SUMMARY OF THE INVENTION

It is therefore an object of the present invention to significantly reduce the occurrence of breakdown points in a thin-film EL panel to thereby improve the quality of its display.

A thin-film EL panel embodying the present invention with which the above and other objects are achieved, has the conventional layer structure with transparent electrodes, a first insulative layer, a light-emitting layer, a second insulative layer and back electrodes stacked in this order on a substrate, but is characterized as having its transparent electrodes shaped differently in the display picture element parts and in other parts.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Breakdown points damage the quality of a display when their size exceeds a certain critical magnitude such as ¼ of the area of a picture element and the function of a display device is thereby seriously affected. The tendency for their occurrence generally depends on the structure of the thin-film EL panel such as its display area and the resistance of its transparent electrodes. Before embodiments of the present invention are explained, therefore, experiments conducted by the present inventors for determining the relationship between the length (or resistance) of ITO films and large breakdown points (defined as breakdown points with diameters greater than 100 μm and hereinafter abbreviated into LBP) will be described in detail.

Figure 4:
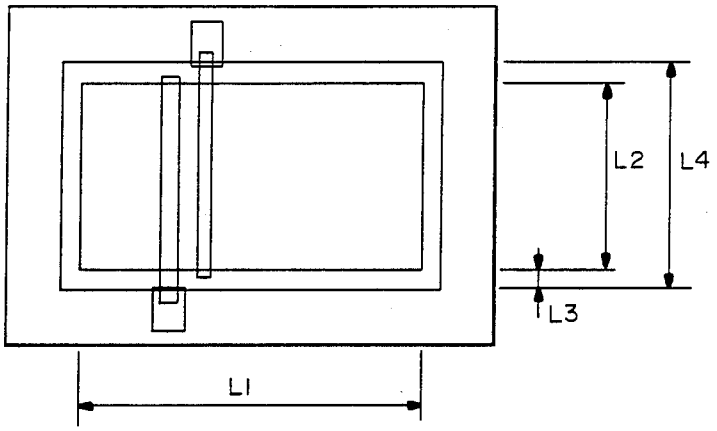
FIGS. 4 and 4 are schematic plan view of a thin-film EL panel for showing positions where measurements were taken in experiments.

In the first experiment, various thin-film EL panels (hereinafter referred to as samples) with different display areas and ITO films with different resistances were prepared as shown in Table 1 and after a continuous aging process of 20 hours at temperature 75° C. and operating voltage of $V_{th}+100$ V, the size (maximum diameter) of each LBP that was generated and its distance from the base end part of the ITO films (the end at which they are connected to the Al-Ni terminal) were measured. FIG. 4 shows the positions at which measurements were taken of each sample. The ITO film resistance was calculated by assuming that its specific resistivity $\rho=2.1\times10^{-4}\Omega$cm and the thickness=1400 Å.

TABLE 1

| Sample No. | Display Area | Picture Element Size | Number of dots | Line Capacity of ITO film | $L_3$ mm | $L_4$ mm | ITO Film resistance | ITO Film resistance |
|---|---|---|---|---|---|---|---|---|
| 1 | 120 × 90 | 0.275 × 0.225 | 320 × 240 | 866 | 6.0 | 96.0 | 330 | 5.2 |
| 2 | 192 × 96 | 0.275 × 0.225 | 512 × 256 | 923 | 4.5 | 100.5 | 250 | 5.5 |
| 3 | 179 × 45 | 0.250 × 0.200 | 512 × 128 | 373 | 5.5 | 50.5 | 330 | 3.0 |
| 4 | 192 × 60 | 0.230 × 0.200 | 640 × 200 | 536 | 4.5 | 64.5 | 290 | 4.2 |
| 5 | 192 × 120 | 0.180 × 0.300 | 640 × 200 | 630 | 4.0 | 125.0 | 420 | 10.4 |
| 6 | 192 × 96 | 0.185 × 0.280 | 640 × 200 | 604 | 4.5 | 100.5 | 360 | 8.1 |
| 7 | 192 × 120 | 0.220 × 0.220 | 640 × 400 | 1129 | 4.0 | 125.0 | 340 | 8.5 |
| 8 | 192 × 84 | 0.185 × 0.240 | 640 × 200 | 518 | 10.5 | 94.5 | 290 | 7.7 |

Figure 7:
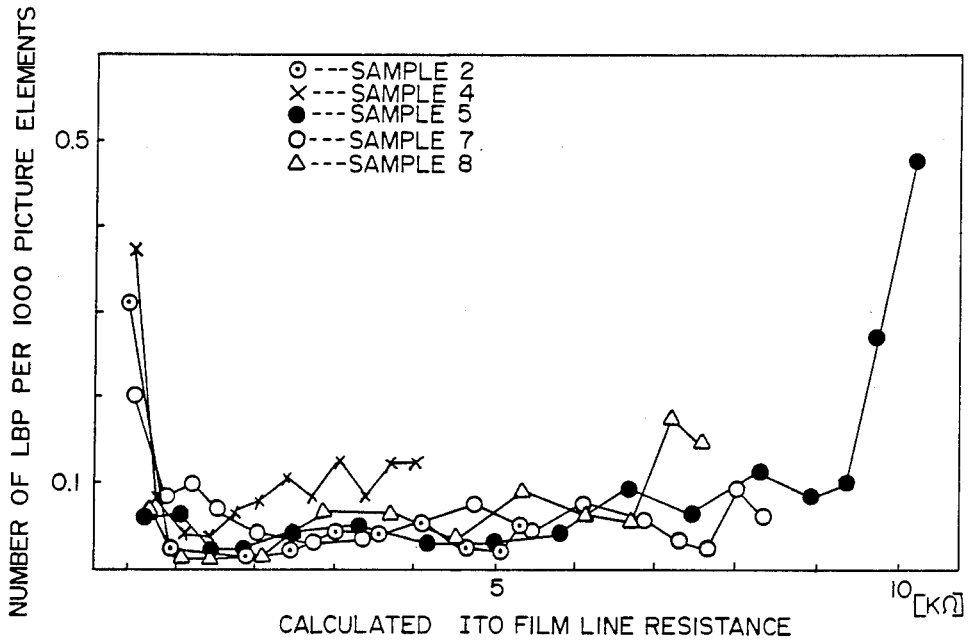
FIGS. 7–9, 10A, 10B, 11–18, 19A, 19B, 20A, 20B, 21A and 21B are graphs showing the results of experiments.

FIG. 7 shows results of this experiment. It shows that LBP occurred frequently in the neighborhood of the ITO film resistance (calculated value)=500Ω in the case of Samples 2, 4 and 7 and that LBP occurred frequently near the opposite end distal from the base end part in the case of Sample 5 were the ITO film resistance is greater than 10kΩ.

In order to understand clearly the cause of occurrence of LPB where the ITO films resistance is high, the following series of experiments was carried out.

Figure 5:
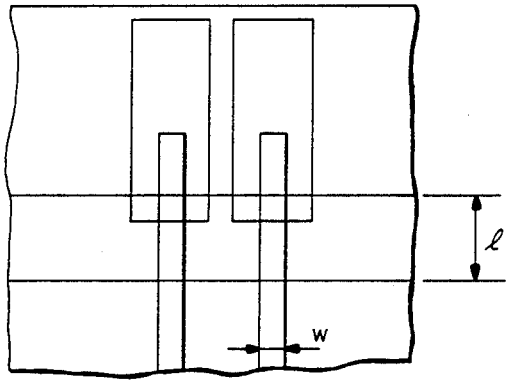

Table 2 shows the samples used for these experiments wherein the samples used in the first experiment are identified by the same Sample Nos. Samples 2', 3' and 4' are the same as Samples 2, 3 and 4, respectively, except the sputtered area of the insulative layers is enlarged. In Table 2, 1 indicates the distance between the insulative layer and the first picture element and W is the widths of the ITO films as shown in FIG. 5. S indicates the area of each picture element and n indicates the number of picture elements in one line.

TABLE 2

| Sample No. | Number of dots | l(mm) | W(mm) | S(mm$^2$) | n | Snl/W |
|---|---|---|---|---|---|---|
| 1 | 320 × 240 | 6 | 0.275 | 0.275 × 0.225 | 240 | 324 |
| 2 | 512 × 256 | 4.5 | 0.275 | 0.275 × 0.225 | 256 | 259 |
| 2' | 512 × 256 | 6.5 | 0.275 | 0.275 × 0.225 | 256 | 374 |
| 3 | 512 × 128 | 5.5 | 0.250 | 0.250 × 0.200 | 128 | 141 |
| 3' | 512 × 128 | 12.0 | 0.250 | 0.250 × 0.200 | 128 | 307 |
| 4 | 640 × 200 | 4.5 | 0.230 | 0.230 × 0.200 | 200 | 180 |
| 4' | 640 × 200 | 6.5 | 0.230 | 0.230 × 0.200 | 200 | 260 |
| 5 | 640 × 200 | 4.0 | 0.180 | 0.180 × 0.300 | 200 | 240 |
| 6 | 640 × 200 | 4.5 | 0.185 | 0.185 × 0.280 | 200 | 252 |
| 7 | 640 × 400 | 4.0 | 0.220 | 0.220 × 0.220 | 400 | 352 |
| 8 | 320 × 256 | 4.14 | 0.220 | 0.220 × 0.220 | 256 | 233 |
| 9 | 320 × 256 | 4.14 | 0.190 | 0.220 × 0.220 | 256 | 270 |

Figure 6:
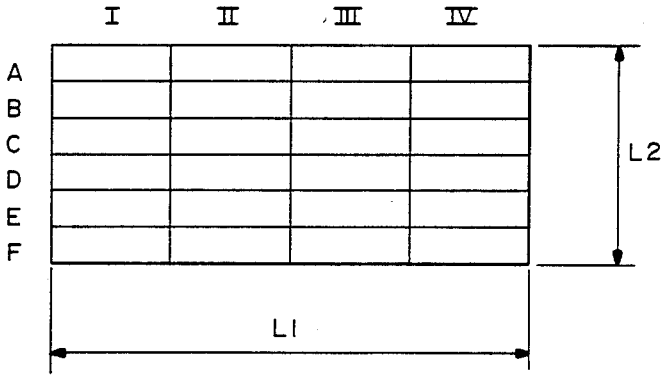
FIG. 6 is a schematic plan view of a display part of a thinfilm EL panel tested in experiments.

In the second experiment, distribution of LBP and BP was measured. For this purpose, the display part 16 of each sample described in Table 2 was divided into six sections A–F in the transverse direction and four sections I–IV in the longitudinal direction, or into a total of 24 regions as shown in FIG. 6, depending on the difference in ITO film resistance, and the number of LBP and BP inside the display part was obtained and the relationship between the measured number and the ITO film resistance was studied.

In the third experiment, the relationship between the ITO film resistance or external resistance and the size of BP caused by a direct current (DC) was investigated. For this experiment, a DC was applied with the ITO film at a positive voltage to generate BP and the relationship between the ITO film resistance (length) and the size of BP was investigated. In addition, various external resistors were inserted between the DC source and the sample on the side of the base end part of the ITO film to generate BP and the relationship between such external resistance and the size of BP was studied.

The four experiment was comprised of BP acceleration tests at 75° C. with applied voltage of $V_{th}+100$ V and the rate of increase in BP, their average size, etc. were studies. After each test, the relationship between the ITO film resistance and the number and size of BP was studies for each sample.

Tables 3–6 show the distribution of LBP and BP on four kinds of Sample 5 after an aging process. In Tables 3–6, ITO(long) indicates LBP and BP generated on the part within the region distal from the base end part of the ITO film and ITO(short) indicates those generated on the part within the region proximal to the base end part of the ITO film. In regions from C–I to C–IV and from D–I to D–IV, no distinction is made because the lengths of the ITO films are nearly equal from both end parts.

TABLE 3

| | I | II | III | IV | |
|---|---|---|---|---|---|
| A | 1/0 (0/0) | 0/1 (0/0) | 0/1 (0) | 1/4 (0/1) | 2/6 (0/1) |
| B | 4/2 (0/0) | 4/1 (1/0) | 2/2 (0/1) | 3/4 (0/1) | 13/9 (2/1) |
| C | 4 (1) | 2 (0) | 2 (0) | 5 (0) | 15 (1) |
| D | 9 (0) | 0 (0) | 3 (0) | 3 (0) | 13 (0) |
| E | 3/2 (0) | 0/0 (0) | 1/0 (0/0) | 0/3 (0/0) | 4/5 (0/0) |
| F | 2/2 (1/0) | 2/3 (1/0) | 1/4 (0/0) | 1/5 (0/0) | 6/14 (2/0) |

17/14 (2/1) + 8/20 (2/1) = 25/34 (4/2)

ITO(long)/ITO(short): Numbers inside ( ) indicate LBP of 100 μm or greater

TABLE 4

| | I | II | III | IV | |
|---|---|---|---|---|---|
| A | 23/35 (10/1) | 20/32 (4/1) | 25/33 (2/0) | 2/3 (0/1) | 70/103 (16/3) |
| B | 8/13 (0/0) | 8/23 (1/3) | 13/15 (2/0) | 5/6 (0/2) | 34/57 (3/5) |
| C | 28 (5) | 14 (0) | 27 (2) | 12 (1) | 81 (8) |
| D | 21 (3) | 9 (0) | 21 (1) | 1 (0) | 52 (4) |
| E | 6/6 (0/0) | 2/5 (0/1) | 8/9 (3/0) | 2/4 (0/0) | 18/24 (3/1) |
| F | 7/8 (1/0) | 5/8 (0/0) | 5/13 (1/0) | 1/5 (1/0) | 18/34 (3/0) |

52/81 (6/6) + 88/137 (19/3) = 140/218 (25/9)

ITO(long)/ITO(short): Numbers inside ( ) indicate LBP of 100 μm or greater

TABLE 5

| | I | II | III | IV | |
|---|---|---|---|---|---|
| A | 9/5 (3/0) | 4/6 (0/2) | 4/2 (0/0) | 10/5 (2/0) | 27/18 (5/2) |
| B | 8/3 (2/0) | 2/2 (0/0) | 3/0 (1/0) | 6/8 (1/1) | 19/13 (4/1) |
| C | 6 (2) | 3 (1) | 5 (1) | 9 (0) | 23 (4) |
| D | 4 (0) | 3 (0) | 2 (0) | 4 (0) | 13 (0) |
| E | 3/4 (0/0) | 3/1 (0/0) | 0/6 (0/0) | 0/2 (0/0) | 6/7 (0/0) |
| F | 2/3 (2/0) | 5/3 (0/0) | 0/0 (0/0) | 1/2 (0/0) | 8/8 (2/0) |

25/20 (4/1) + 35/26 (7/2) = 60/46 (11/3)

ITO(long)/ITO(short): Numbers inside ( ) indicate LBP of 100 μm or greater

TABLE 6

| | I | II | III | IV | |
|---|---|---|---|---|---|
| A | 4/2 (0/0) | 0/7 (0/0) | 5/5 (1/0) | 2/4 (0/0) | 11/18 (1/0) |
| B | 3/2 (1/0) | 4/4 (1/0) | 1/1 (0/0) | 1/7 (0/0) | 9/14 (2/0) |
| C | 4 (1) | 2 (1) | 11 (0) | 3 (1) | 20 (3) |
| D | 3 (0) | 5 (0) | 6 (1) | 6 (1) | 20 (2) |
| E | 3/2 (0/0) | 1/1 (0/0) | 4/5 (0/0) | 4/7 (2/1) | 12/15 (2/1) |
| F | 3/2 (0/0) | 5/2 (0/0) | 4/6 (0/0) | 5/2 (0/1) | 17/12 (0/1) |

21/29 (4/1) + 28/30 (1/1) = 49/59 (5/2)

ITO (long)/ITO(short): Numbers inside ( ) indicate LBP of 100 μm or greater

Tables 3–6 show that 2–3 times more LBPs are generated as a whole where the ITO film resistance is high than where it is low. By contrast, nearly the same number of or about 50% more BPs are generated as a whole where the ITO film resistance is low. This agrees with the result with Sample 5 that LBPs and missing picture elements occur frequently where the ITO film resistance is high. It may be concluded,therefore, that in the case of a sample like this with high ITO film resistance (10.4kΩ), the probability of BPs growing (in propagating mode, hereinafter abbreviated into P mode) is high in regions where the ITO film resistance is high.

Figure 8:
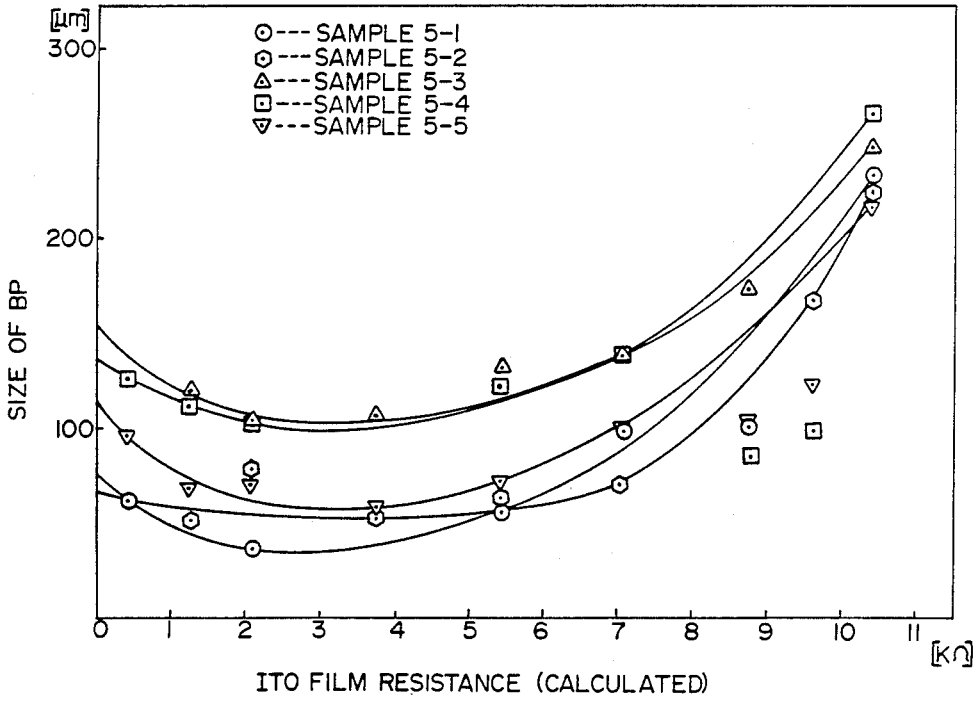

To study the relationship between the ITO film resistance and the size of BP caused by a DC, FIG. 8 shows the relationship between the ITO film resistance (calculated from specific) resistance of $2.1\times10^{-4}\Omega$cm) of Sample 5 and the size of BP based on tests on Samples 5-1, 5-2, 5-3, 5-4 and 5-5. Although there are some differences among these five samples, it is observed with all of them that the size of BP increases suddenly when the ITO film resistance exceeds 5kΩ and that is also tends to increase when the ITO film resistance is below 1kΩ. It is also observed that when the ITO film resistance is greater than 8–9kΩ (that is, the ITO film length is over 9–10 cm), the BP mode has a strong tendency to switch from the self-healing mode (hereinafter abbreviated into S mode) to the P mode, or the fraction of P mode increases.

Figure 9:
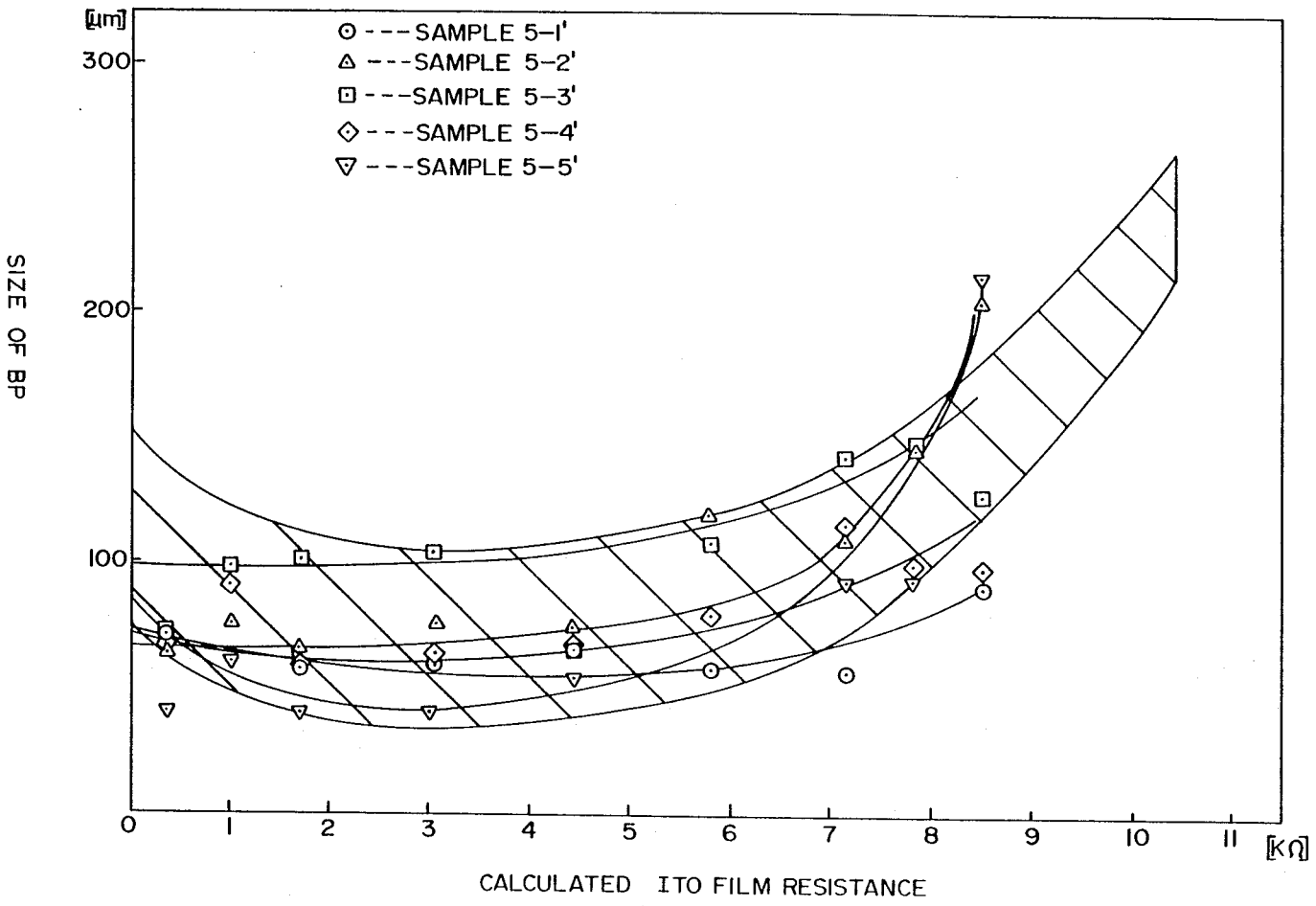

FIG. 9 shows the relationship between the ITO film resistance and the size of BP with Sample 5 when the widths of the ITO films is 220 μm. For this purpose, five samples 5-1', 5-2', 5-3', 5-4' and 5-5' were used. It is noted that there are few regions where BP is large as a whole compared to the samples used for FIG. 8. It is also noted that the relationship between the size of BP and the ITO film resistance is nearly the same between these two sets of samples and that the size of BP at the distal end part of the ITO film depends on the value of resistance of the ITO films. Thus, with the other conditions kept the same, the resistance at the distal end part of the ITO film decreases if the widths of the ITO film is increased from 180 μm to 220 μm and size of BP caused by a DC become smaller.

Figure 10A:
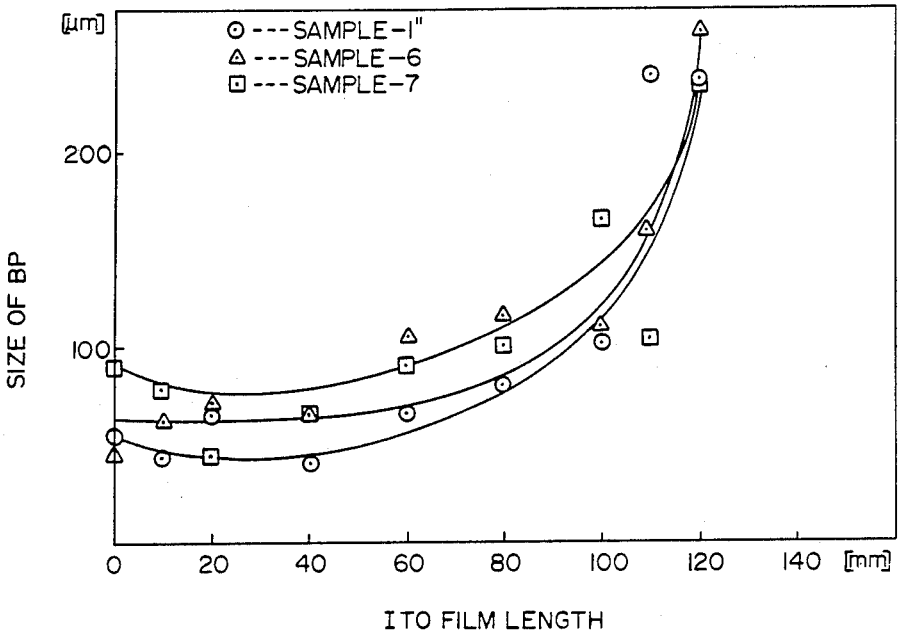
Figure 10B:
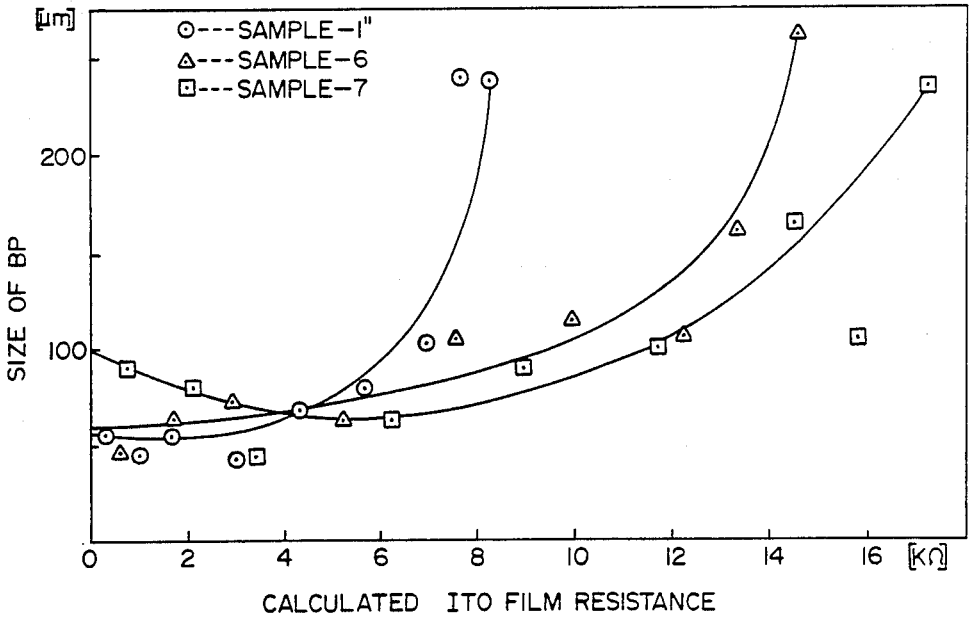

FIGS. 10A and 10B show the relationships of the size of BP with the ITO film length and resistance in the case of Sample 5 when the film thickness is changed from 1400 Å to 1700 Å to thereby reduce its ITO film resistance. In these figures, Sample 5-1" has film thickness of 1700 Å and measured ITO film resistance of 8.2kΩ. Samples 5–6 and 5–7 have the usual film thickness of 1400 Å, their measured ITO film resistance being 14.5kΩ and 17.2kΩ, respectively. FIG. 10A shows that these three samples exhibit a similar relationship between the size of BP and the ITO film length but FIG. 10B shows that there is hardly any similarity in relationship between the size of BP and the ITO film resistance. This seems to imply that the size of BP is influenced not only by the ITO film resistance but also by the length of the ITO film, that is, the position of breakdown within the sample.

Figure 11:
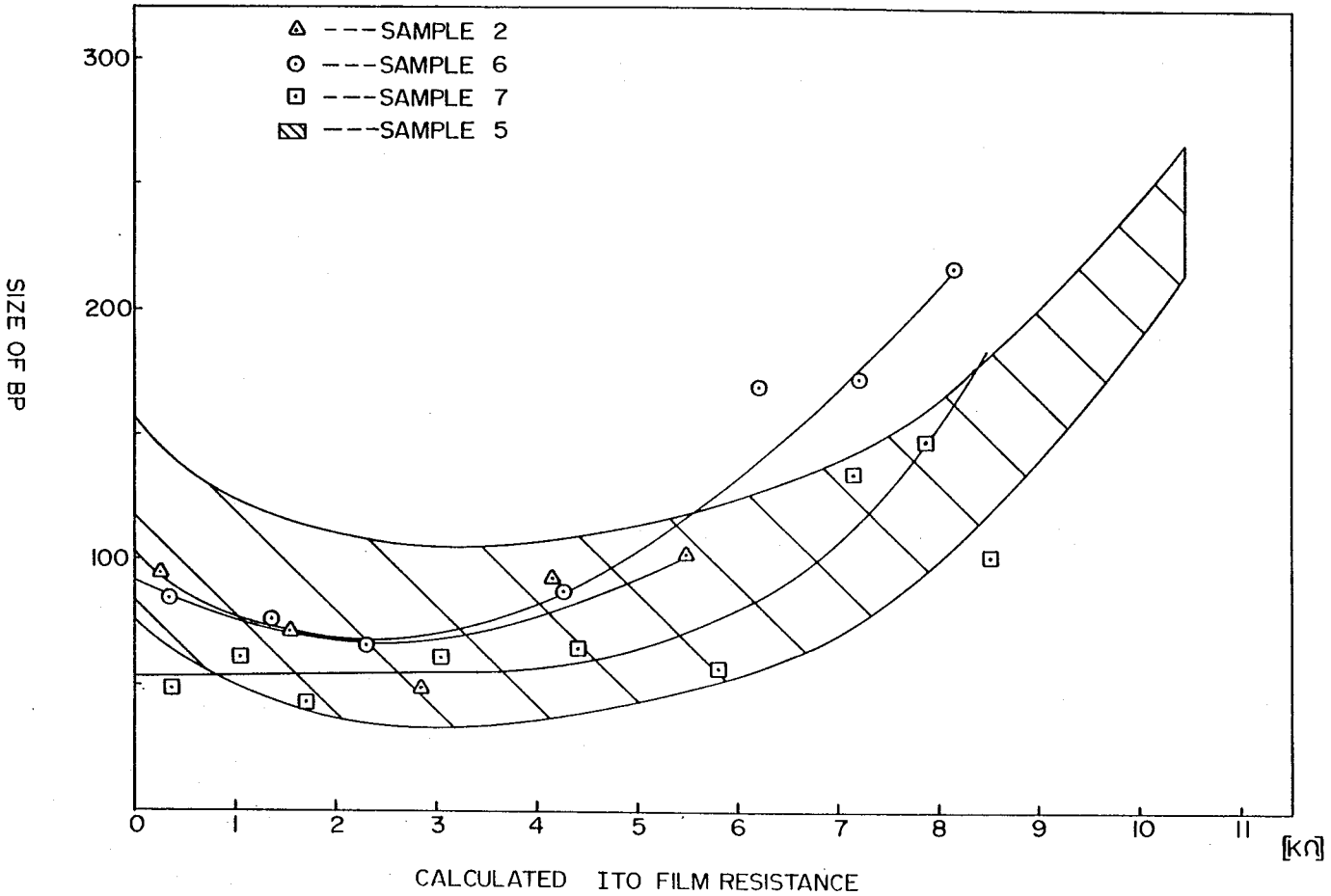

FIG. 11 shows the relationship between the calculated ITO film resistance and the size of BP obtained from Samples 2, 6 and 7. There are some differences from the result with Sample 5 but it can be seen that the largest size of BP is influenced by the ITO film resistance.

Table 7 shows the results of experiment for studying the relationship between external resistance used with different samples and the size of BP. Measurements were all taken at the picture element closest to the base end part of the ITO film where the ITO film resistance is the smallest. Table 7 shows as a whole that BP becomes larger as the external resistance is increased, and that this tendency is most conspicuous with Sample 5 while it is weak with Samples 3-1, 3-2 and 2-1 with small display areas. Among samples with the same display area such as Samples 5-1 through 5-3, 5-1' through 5-3', 5-8 and 7-1, those with a greater vertical-to-horizontal ratio such as Samples 5-1 through 5-3 and 5-8 produce larger BP for the same external resistance.

TABLE 7

| Sample No. | External Resistance 0.47 | 1 | 2.2 | 3.3 | 4.7 | 5.6 | 10 | 39 | 56 | 100 | 470 |
|---|---|---|---|---|---|---|---|---|---|---|---|
| 5 - 1 | | | | | | 34 | 152 | | 112 | 173 | |
| 5 - 3 | 152 | 84 | 154 | 168 | 211 | 225 | 252 | | 225 | | |
| 5 - 4 | 129 | 92 | 167 | 220 | 161 | 235 | 251 | | 217 | 220 | 237 |
| 5 - 1' | | | | | | 57 | 67 | 136 | 162 | 246 | |
| 5 - 2' | | 64 | | | | 101 | 99 | | 83 | 95 | |
| 5 - 3' | | 131 | | 148 | | 128 | 101 | | 203 | 179 | |
| 5 - 8 | | 124 | | | | 177 | 128 | | 169 | 135 | 236 |
| 2 - 1 | | | | | | 65 | 104 | | 126 | 105 | 160 |
| 7 - 1 | | | | 42 | | 48 | 80 | | 134 | 91 | |
| 3 - 1 | | 46 | | 74 | | 69 | 121 | | 113 | 154 | |
| 3 - 2 | | 68 | | 156 | | 117 | 178 | | 131 | 154 | |
| 6 - 1 | | 111 | | 120 | | 128 | 162 | | 224 | 138 | |

(Unit: μm)

Figure 12:
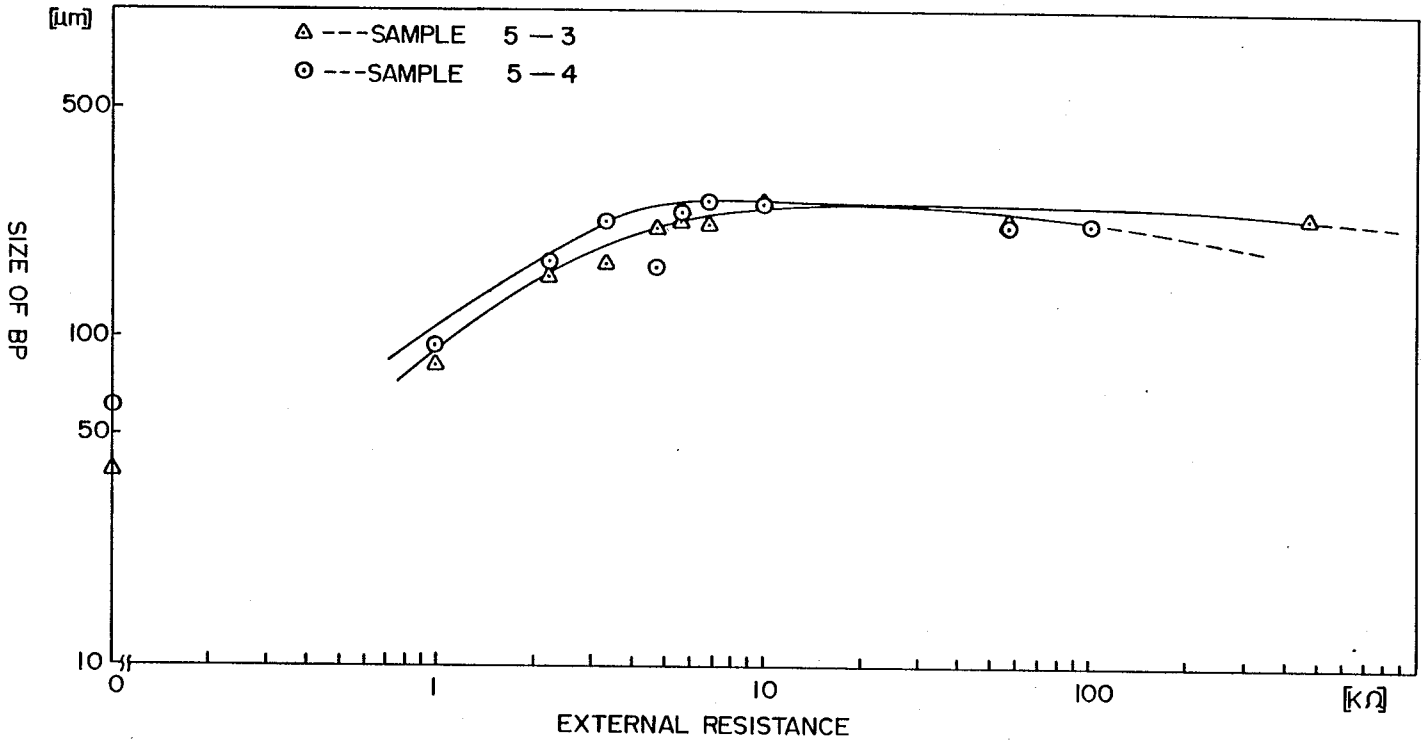
Figure 13:
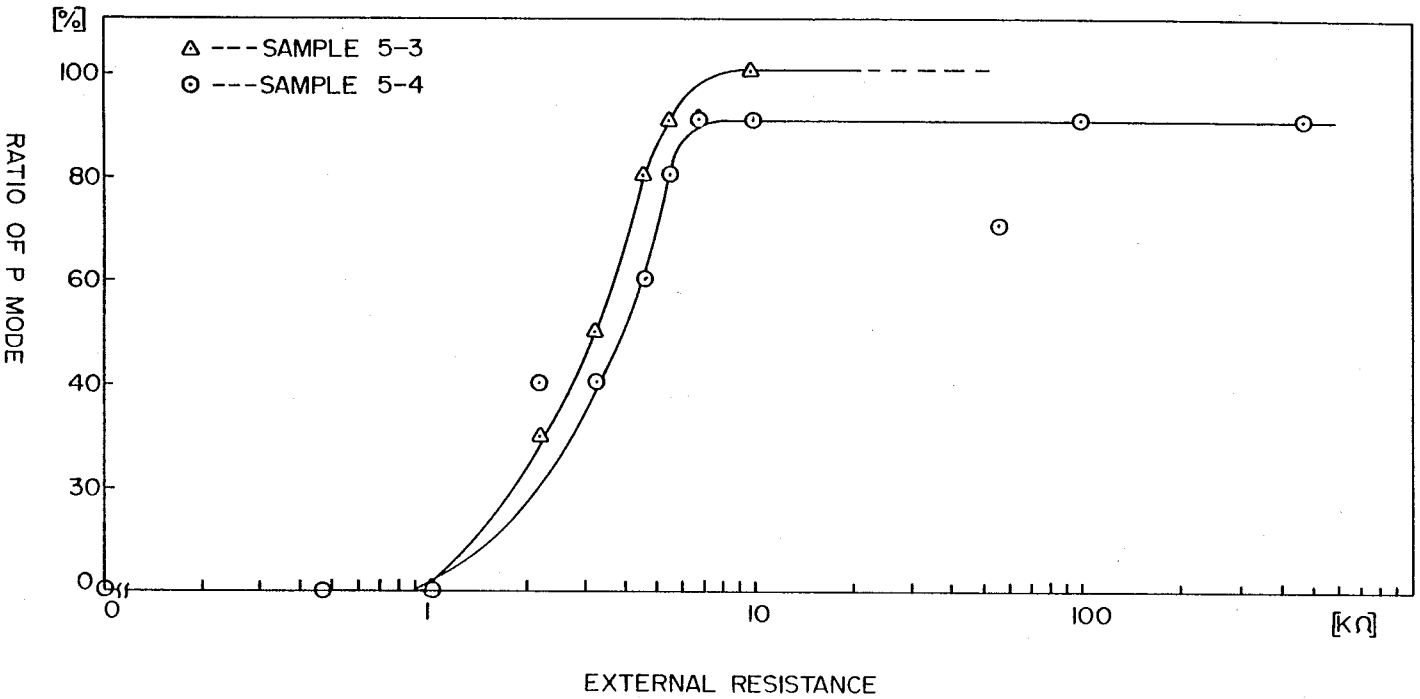
Figure 14:
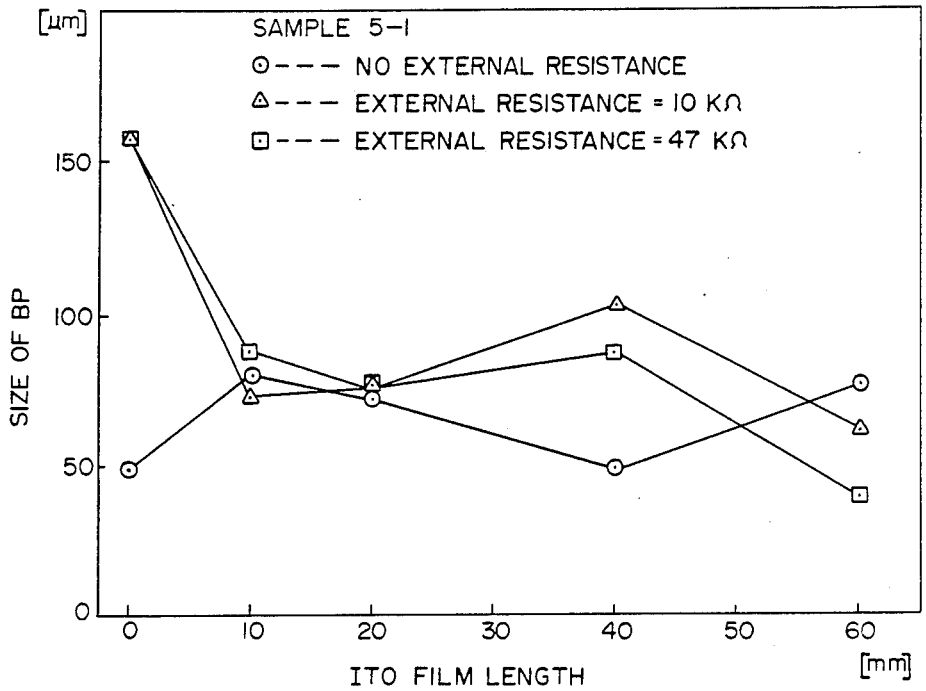
Figure 15:
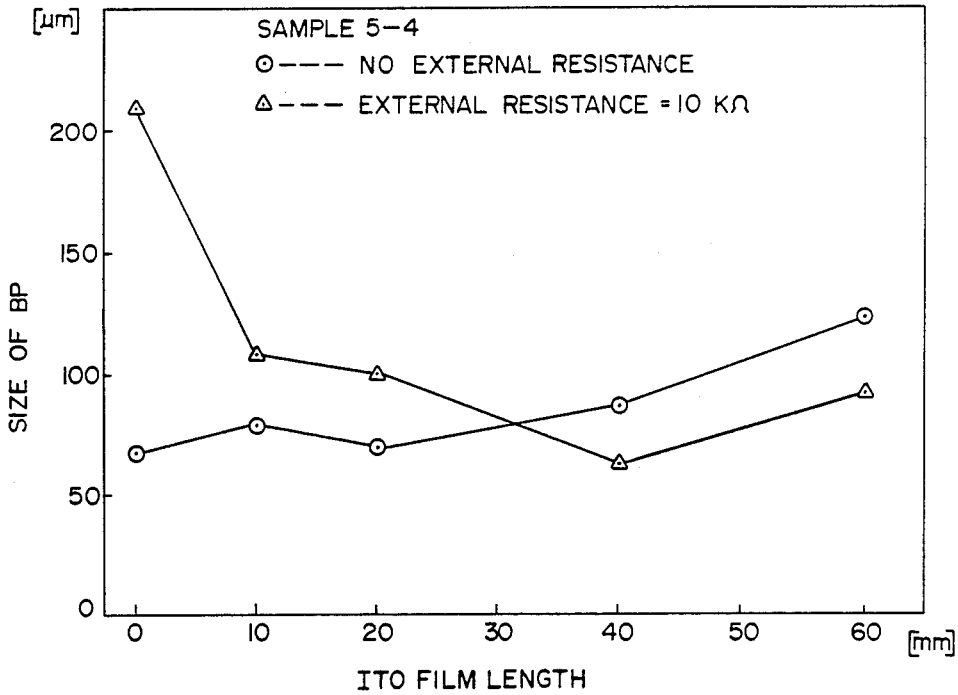

FIG. 12 shows the relationship between the external resistance and the size of BP with Samples 5-3 and 5-4. The size of BP increases within the range of several kΩ to 10kΩ and becomes saturated in the range therebeyond. FIG. 13 shows the relationship between the external resistance and the ratio of picture elements which enter the P mode upon breakdown. The ratio of P mode varies widely between 2kΩ and 10kΩ. The degree of change is greater than in FIG. 11. It may therefore be concluded that the size of BP increases with each example of Sample 5 as the external resistance is increased because a resistance greater than a certain value between the power source and the picture element can strongly influence the picture element going into the P mode upon breakdown. FIGS. 14 and 15 show the relationship between the length of ITO film and the size of BP obtained by moving the position of measurement gradually from the base end part of the ITO film to the opposite end for studying the relationship between the position of BP in Samples 5-1 and 5-4 and the external resistance. It is noted with both Samples 5-1 and 5-4 that the size of BP increases by the insertion of an external resistance greater than 10kΩ only within about 10 mm from the base end of the display part and that there is hardly any difference near the center of the display part whether an external resistance is inserted or not. This seems to suggest that the BP does not become large simply because an external resistance is inserted but that is become large if a resistance greater than a certain value is inserted between the picture element and the DC source when the ITO film in the peripheral regions of the display part is more deteriorated than at the center region. Although the results explained above relate to BP generated by a DC, it is believed that similar conclusions will be obtained in the case of actual AC operations.

Figure 16:
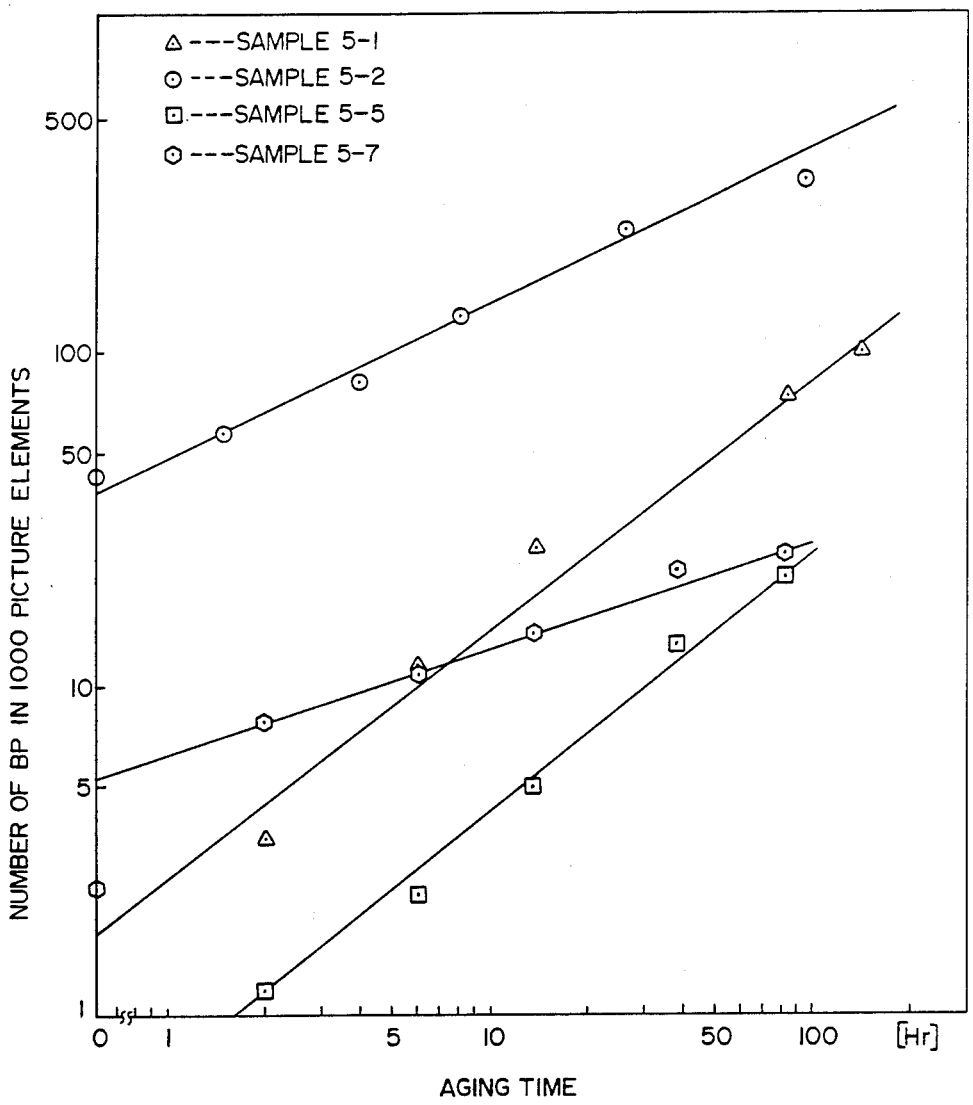
Figure 18:
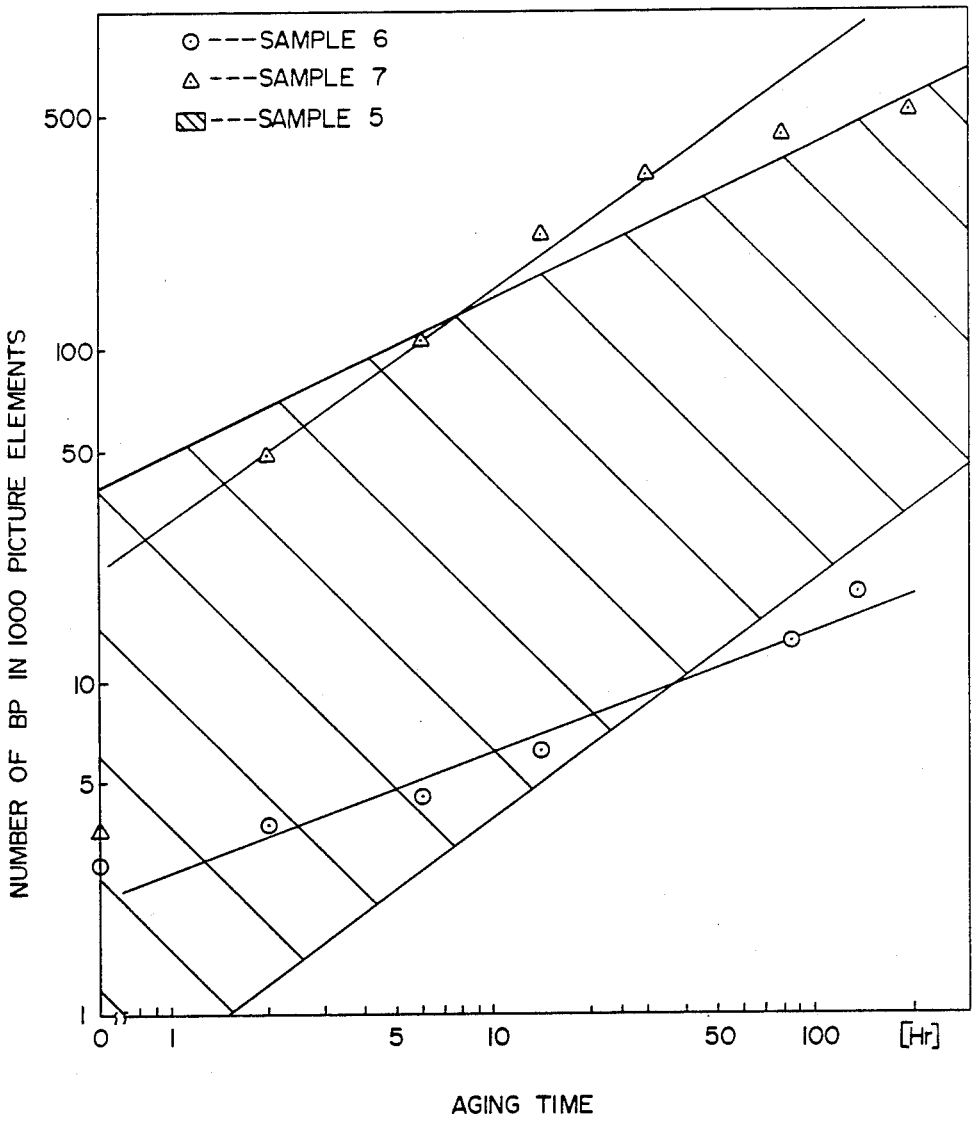
Figure 19A:
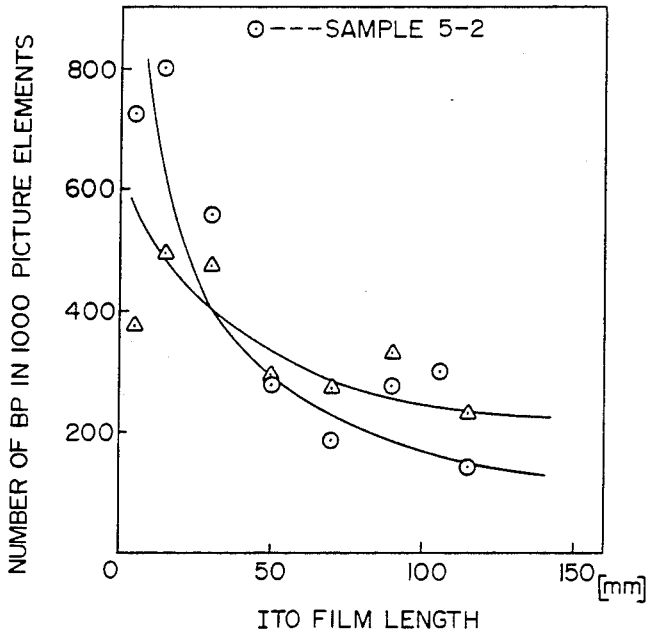
Figure 19B:
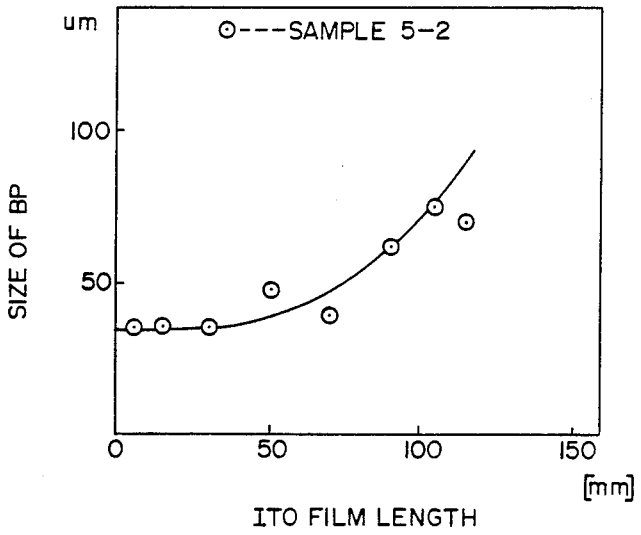
Figure 20A:
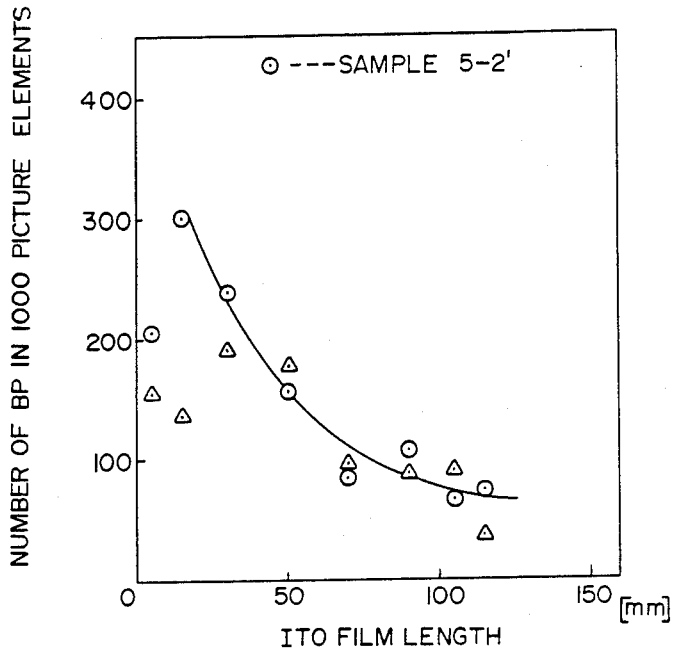
Figure 20B:
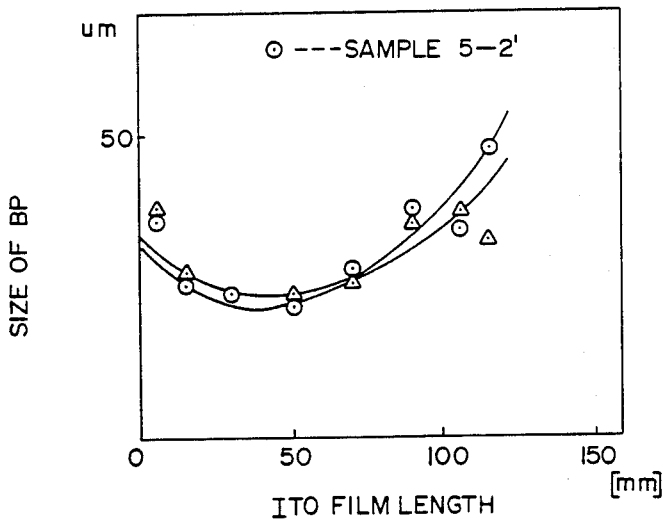
Figure 21A:
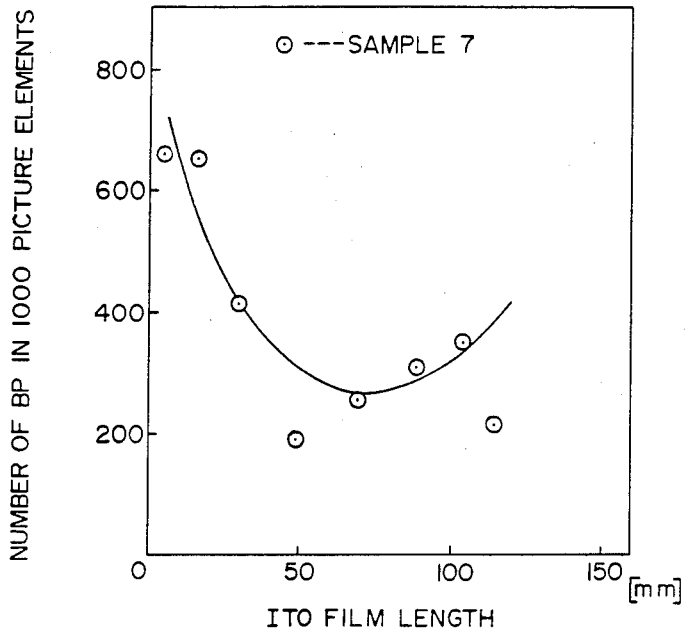
Figure 21B:
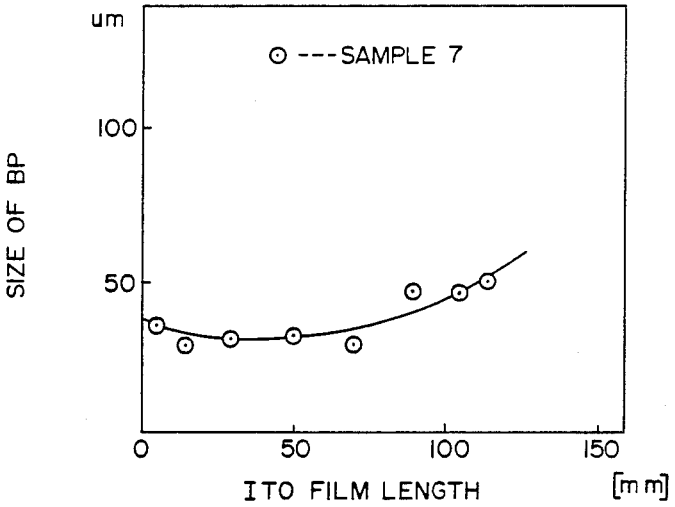
Figure 22:
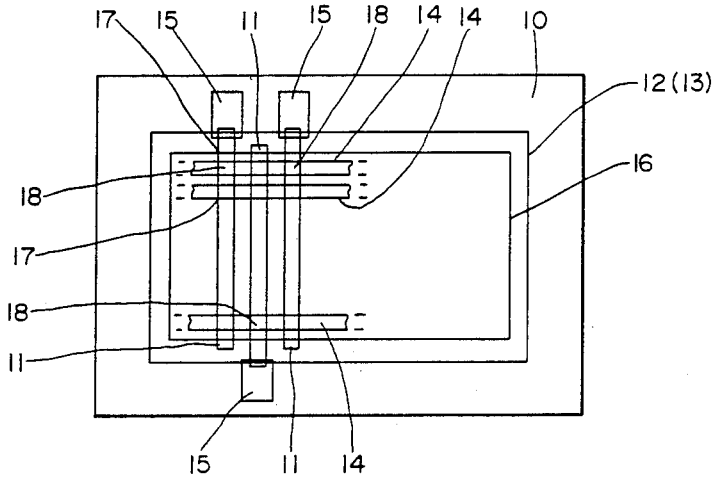
(PRIOR ART) FIG.-22
FIGS. 22 and 23 are schematic plan view of portions of prior art thin-film EL panels.
Figure 23:
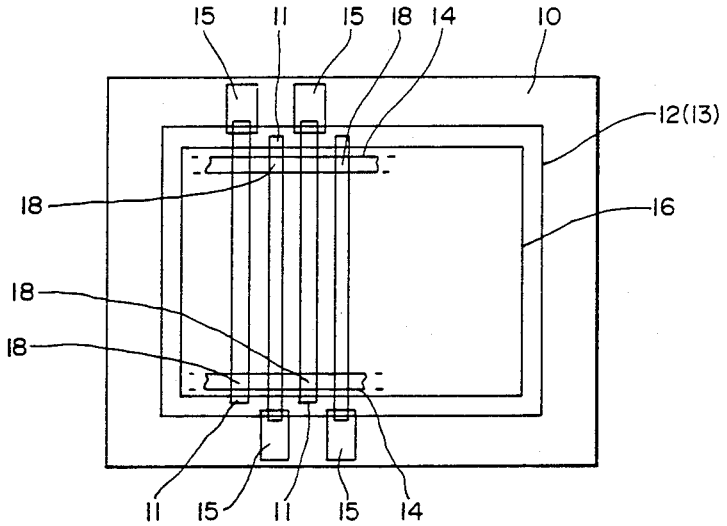
(PRIOR ART) FIG.-23

FIG. 16 shows the relationship between the time of aging and the number of BP obtained from Samples 5-1, 5-2, 5-5 and 5-7. FIG. 7 shows the same relationship obtained from Samples 5-6' and 5-7' with ITO film thickness changed from 1400 Å to 1700 Å and Sample 5-9 having the normal film thickness of 1400 Å. Measurements were taken for this figure at the left-hand and right-hand ends, that is, at both ends of the ITO film in the direction of its widths. FIG. 18 shows this relationship obtained from Samples 6 and 7. Table 8 shows the results of BP acceleration tests on these samples.

TABLE 8

| Sample No. | Test time (H) | Rate of Increase | Number of BP (/1000) | 1/λ (μm) | Remarks |
|---|---|---|---|---|---|
| 5 - 1 | 132.0 | 0.76 | 96.5 (132 H) | 18.1 | |
| 5 - 2 | 94.8 | 0.43 | 315.9 (95 H) | 28.7 | Many LBP where ITO film is long |
| 5 - 5 | 82.2 | 0.80 | 20.8 (82 H) | 18.3 | |
| 5 - 6' | 82.2 | 1.03 | 194.5 (82 H) | 14.6 | |
| 5 - 7 | 82.2 | 0.32 | 24.1 (82.2) | 30.9 | Some LBP |
| 5 - 8 | 82.2 | 0.46 | 15.2 (82 H) | 16.5 | |
| 5 - 9 | 89.8 | 0.27 | 14.9 (89 H) | 20.9 | (ref.) |
| 5 - 10 | 89.8 | 0.25 | 2.6 (89 H) | 23.5 | Ni removed |
| 5 - 11 | 89.8 | 0.43 | 6.3 (89 H) | 17.4 | ITO film thickness = 1700Å |
| 6 | 132.0 | 0.39 | 18.6 (132 H) | 14.1 | |
| 7 | 192.3 | 0.52 | 501.5 (192 H) | 24.1 | Some LBP |

Figure 17:
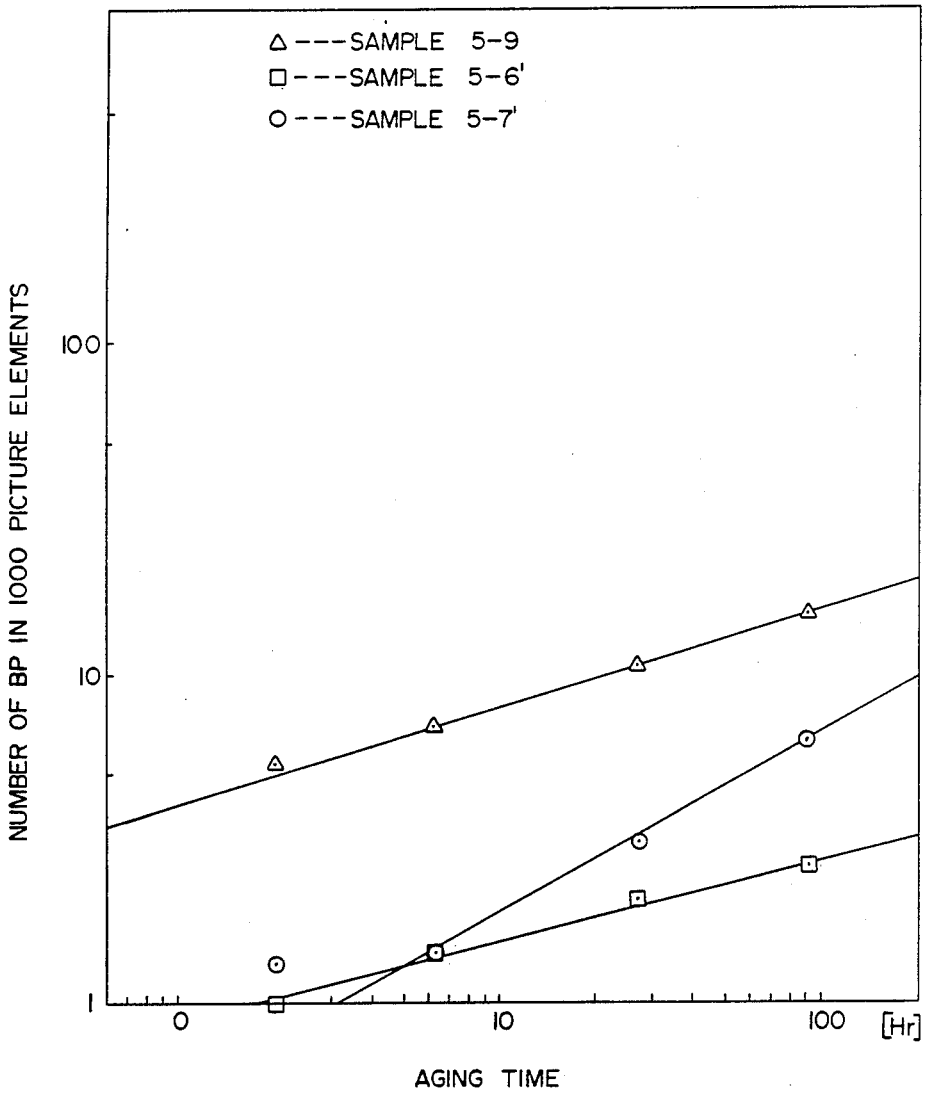

FIG. 16 shows as a whole that both the nubmer of BP and the rate of its increase are fairly large. It is also to be noted that LBP occurred in the case of Sample 5-2 at the distal end part of the ITO film. The number of BP shown in FIG. 17 is also large but the average size of BP which occurred (1/λ in Table 8) is sufficiently small and there is not LBP. It is to be noted that Sample 5-6' obtained by removing Ni by etching shows no difference from Sample 5-9 having the normal film thickness. On the other hand, there is no occurrence of LBP on Sample 5-9 although its ITO film resistance is as large as 16.9kΩ. This seems to indicate that the LBP-producing mode which is peculiar to Sample 5 does not occur even with the ITO film resistance of about 17kΩ if the quality and composition of the thin-film EL panel are not deteriorated. In FIG. 18, the number of BP is large and there are not a few occurrences of LBP but the number is not large.

FIGS. 19A, 19B, 20A, 20B, 21A and 21B show the effects of the length of ITO film on the number of BP and the distribution of its size after a BP acceleration test. It is noted that the number of BP decreases as a whole as the length of ITO film (film resistance) increases and that the size of BP increases if the ITO film length exceeds 80 mm. These tendencies are no more conspicuous than in the case of the aforementioned second experiment but they agree in that the size of BP increases as the ITO film resistance increases.

From the results of the second, third and fourth experiments described above, it may be concluded that the principal cause for the occurrence of LBP where the ITO film resistance is high (that is, near the distal end of the ITO film) is that the breakdown of picture elements do not stop (not going into the S mode) but propagates (entering the P mode) because the current which provides breakdown energy for picture elements becomse limited at the time of occurrence of BP because the LTO film resistance is higher than a specified value such that the BP becomes larger. Altogether, it may be concluded that the occurrence of LBP can be reduced significantly within the display part if the calculated value of ITO film resistance at the display part of the thin-film EL panel is set in the range of 1kΩ–9.5kΩ (or measured value in the ragne of 500Ω–13kΩ).

With the experimental results thus interpreted, the present invention discloses transparent electrodes of a thin-film EL panel of the general structure described above, characterized as having different shapes in the display element area and in other areas. In other words, the occurrence of BP is reduced according to the present invention by changing the shape of transparent electrodes (or ITO films), for example, by varying their widths such that the calculated resistance of the ITO film becomes between 1kΩ and 9.5kΩ. In what follows, the present invention is explained by way of figures which show some embodiments of the present invention.

Figure 1:
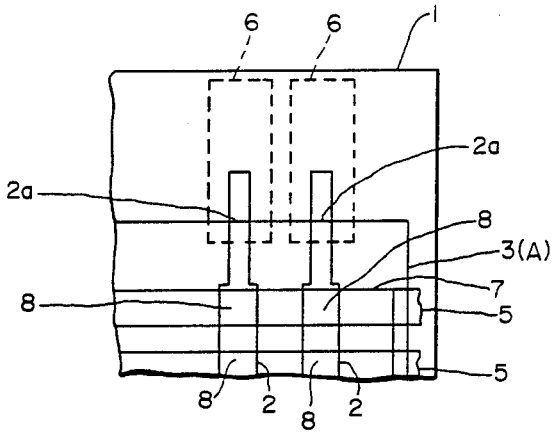
FIGS. 1, 2 and 3 are schematic plan view of portions of thinfilm EL panels each embodying the present invention.

In FIG. 1 which is a plan view of a portion of a thin-film EL element according to the present invention, numeral 1 indicates a glass substrate and numerals 2 indicate transparent electrodes (ITO films) comprising indium oxide ($In_2O_3$) and formed transversely on the glass substrate 1. On these ITO films 2 are a first insulative layer 3, a light-emitting layer (not shown) and a second insulative layer 4 sequentially stacked, and many back electrodes 5 of Al or the like are disposed above the second insulative layer 4 perpendicularly to the ITO films 2. Numerals 6 Al-Ni terminals, numeral 7 indicates a display part and numerals 8 indicate display picture elements. This layer structure, therefore, is not different from the conventional examples. The embodiment of the present invention in FIG. 1 is characterized wherein each of the ITO films 2 is made narrower between its connecting end part 2*a* to the Al-Ni terminal 6 and the display part 7 than inside the display part 7, thereby reducing its area outside the display part 7 and hence increasing its calculated ITO film resistance between the connecting end part 2*a* and the display part 7 so as to be within the range between 1kΩ and 9.5kΩ. This has the effect of increasing the voltage drop along the ITO films 2 between the connecting end part 2*a* and the display part 7 and hence of reducing the occurrence of BP near the base end part.

Figure 2:
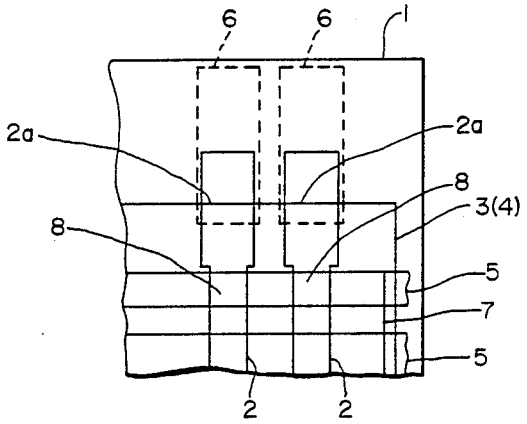

FIG. 2 shows another thin-film EL panel embodying the present invention of which the layer structure is as explained by way of FIG. 1 above. Components which are substantially equivalent to or at least similar to those in FIG. 1 are indicated by the same numerals. This embodiment is characterized as having each of its ITO film 2 wider between its connecting end part 2*a* and the display part 7 than inside the display part 7, thereby increasing its area outside the display part 7 and hence reducing the calculated ITO film resistance so as to be in the range between 1kΩ and 9.5kΩ. This has the effect of reducing the voltage drop along the ITO film 2 between the connecting end part 2*a* and the display part 7 and hence of reducing the occurrence of BP and, in particular, of LBP near the distal end parts of the ITO films 2.

Figure 3:
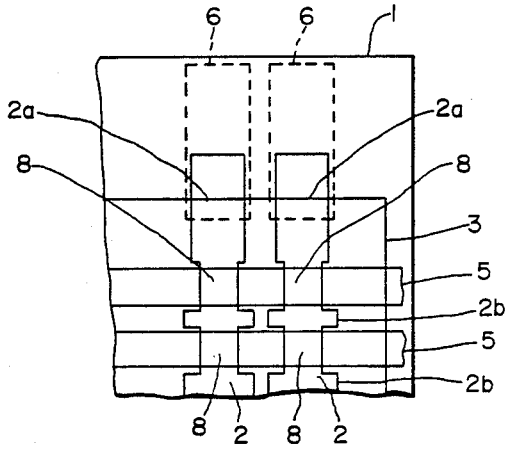

Another embodiment of the present invention shown in FIG. 3 may be considered as a variation of the one explained above by way of FIG. 2. This embodiment is useful when the resistance of the ITO film 2 is too large even after its width is increased between its connecting end part 2*a* and the display part 7. More in detail, the ITO film 2 according to this embodiment is identical to those shown in FIG. 2 except its width is increased inside the display part 7 and between two mutually adjacent picture elements 8, that is, at the positions of the gaps between the mutually adjacent pairs of back electrodes 5. The ITO film resistance can be further reduced by this design.

In summary, transparent electrodes of a thin-film EL panel according to the present invention are so designed that their shapes outside the areas of the display picture elements are modified and their areas are so adjusted that the occurrence of BP can be significantly reduced. Accordingly, the display quality of the thin-film EL panel can be improved.

The foregoing description of preferred embodiments of the invention have been presented for purposes of illustration and description. It is not intended to be exhaustive or to limit the invention to the precise form disclosed, and many modifications and variations are possible in light of the above teaching. Any modifications and variations that may be apparent to a person skilled in the art are intended to be included within the scope of this invention.

What is claimed is:

1. In a thin-film EL panel having transparent electrodes formed on a substrate and a first insulative layer, a light-emitting layer, a second insulative layer and back electrodes stacked in this order on said transparent electrodes to define display picture elements on said panel, the improvement wherein the resistance value of parts of said transparent electrodes other than said display picture elements is so controlled as to reduce the occurrence of large breakdown points thereon.

2. The thin-film EL panel of claim 1 wherein said transparent electrodes are elongated and are narrower at said display picture elements than elsewhere.

3. The thin-film EL panel of claim 1 wherein said transparent electrodes are elongated and are broader at said display picture elements than elsewhere.

4. The thin-film EL panel of claim 2 wherein said transparent electrodes comprise indium oxide and have calculated resistance of 1kΩ–9.5kΩ.

5. The thin-film EL panel of claim 3 wherein said transparent electrodes comprise indium oxide and have calculated resistance of 1kΩ–9.5kΩ.

* * * * *